US012345130B2

(12) United States Patent
Pepper

(10) Patent No.: US 12,345,130 B2
(45) Date of Patent: Jul. 1, 2025

(54) FLEXIBLE TRANSMISSION DRIVE JOINT

(71) Applicant: PATRIOT OIL TOOLS INC., Sherwood Park (CA)

(72) Inventor: Stephen Charles Pepper, Sherwood Park (CA)

(73) Assignee: PATRIOT OIL TOOLS INC., Sherwood Park (CA)

( * ) Notice: Subject to any disclaimer, the term of this patent is extended or adjusted under 35 U.S.C. 154(b) by 0 days.

(21) Appl. No.: 18/579,571

(22) PCT Filed: Sep. 12, 2022

(86) PCT No.: PCT/CA2022/051358
§ 371 (c)(1),
(2) Date: Jan. 16, 2024

(87) PCT Pub. No.: WO2023/039661
PCT Pub. Date: Mar. 23, 2023

(65) Prior Publication Data

US 2024/0263516 A1 Aug. 8, 2024

Related U.S. Application Data

(60) Provisional application No. 63/245,503, filed on Sep. 17, 2021.

(51) Int. Cl.
*E21B 4/00* (2006.01)
*E21B 4/02* (2006.01)

(52) U.S. Cl.
CPC ..... *E21B 4/003* (2013.01); *E21B 4/02* (2013.01)

(58) Field of Classification Search
CPC ..... E21B 4/003; E21B 4/02
See application file for complete search history.

(56) References Cited

U.S. PATENT DOCUMENTS 3,285,099 A 11/1966 Parks et al.
4,141,225 A 2/1979 Varner
(Continued)

FOREIGN PATENT DOCUMENTS

CA 2140295 A1 2/1994
CA 2269145 A1 7/2005
(Continued)

OTHER PUBLICATIONS

International Search Report for International Application No. PCT/CA2022/051358 of Mar. 23, 2023.
(Continued)

*Primary Examiner* — Taras P Bemko
(74) *Attorney, Agent, or Firm* — Perilla Knox & Hildebrandt LLP; Kenneth A. Knox

(57) ABSTRACT

A driveline includes a rotor adaptor and a bearing adaptor coupled to opposite ends of a drive shaft. The rotor adaptor includes a first plurality of drive pockets. Each of the first plurality of drive pockets receives a drive ball rotatably held between each of the first plurality of drive pockets and the end of the drive shaft. The bearing adaptor includes a second plurality of drive pockets. Each of the second plurality of drive pockets receives a drive ball rotatably held between each of the second plurality of drive pockets and the opposite end of the drive shaft. Each of the plurality of drive balls includes a flat surface and each of the first plurality of drive pockets and the second plurality of drive pockets includes a flat thrust face. The flat surface receives a rotational force from the flat thrust face in response to rotating the rotor adaptor.

7 Claims, 6 Drawing Sheets

(56) References Cited

U.S. PATENT DOCUMENTS

| | | | | |
|---|---|---|---|---|
| 5,547,032 | A | 8/1996 | Wenzel | |
| 8,062,140 | B2 * | 11/2011 | Wall | F16D 3/20 464/7 |
| 8,235,829 | B2 | 8/2012 | Kozlowski | |
| 8,251,828 | B2 | 8/2012 | Kozlowski | |
| 8,925,204 | B2 | 1/2015 | Kozlowski | |
| 9,915,106 | B2 | 3/2018 | Underwood et al. | |
| 10,041,299 | B2 | 8/2018 | Gynz-Rekowski et al. | |
| 10,267,366 | B2 | 4/2019 | Lagrange et al. | |
| 2009/0275415 | A1 * | 11/2009 | Prill | F16D 3/2052 464/152 |
| 2009/0298597 | A1 * | 12/2009 | Wall | E21B 17/03 464/140 |
| 2010/0313692 | A1 | 12/2010 | Wenzel | |
| 2012/0196690 | A1 * | 8/2012 | Altimas | F16D 3/185 464/155 |
| 2013/0288810 | A1 * | 10/2013 | Foote | F16D 3/221 464/143 |
| 2016/0108970 | A1 | 4/2016 | Baudoin | |
| 2016/0319883 | A1 | 11/2016 | Gynz-Rekowski et al. | |
| 2018/0216418 | A1 | 8/2018 | Gopalan | |
| 2021/0071491 | A1 | 3/2021 | Strilchuk | |

FOREIGN PATENT DOCUMENTS

| | | | | |
|---|---|---|---|---|
| CA | 2814297 | C | 4/2016 | |
| WO | 2009132414 | A1 | 12/2008 | |
| WO | WO-2014107813 | A1 * | 7/2014 | E21B 4/02 |
| WO | 201735929 | A1 | 3/2017 | |
| WO | 2019144507 | A1 | 8/2019 | |

OTHER PUBLICATIONS

Written Opinion for International Application No. PCT/CA2022/051358 of Mar. 23, 2023.

* cited by examiner

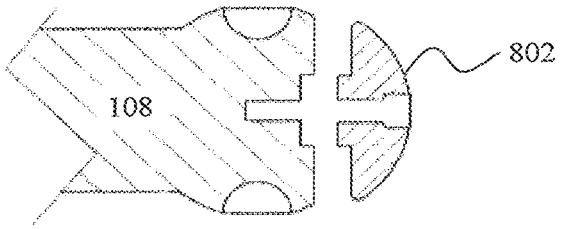
Fig 8 - A
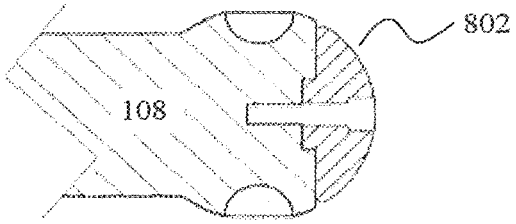
Fig 8 - B
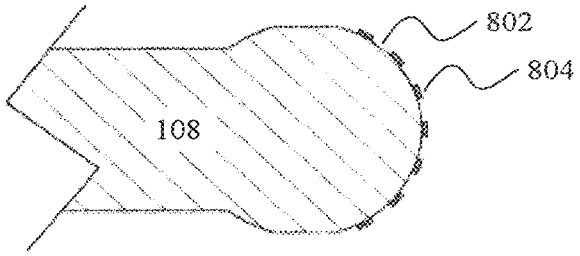
Fig 8 - C

FLEXIBLE TRANSMISSION DRIVE JOINT

CROSS-REFERENCE TO RELATED APPLICATIONS

This application is a national phase application under 35 U.S.C. § 371 of International Application No. PCT/CA2022/051358 filed Sep. 12, 2022, which claims the benefit of and priority to U.S. Provisional Application No. 63/245,503 filed Sep. 17, 2021, the contents of both of which being incorporated by reference in their entireties herein.

FIELD OF THE INVENTION

The present invention pertains to the field of drilling apparatus used for the exploration and extraction of hydrocarbons and in particular to a driveline and bearing pack used in drilling.

BACKGROUND

The exploration and extraction of hydrocarbons typically requires drilling deep wells into the earth. Modern drill bits are driven by a hydraulic positive displacement motor (PDM). The torque from the rotor of the PDM is transferred to a drill bit via a driveline and bearing pack. A typical driveline consists of an outer housing, rotor adaptor, drive elements, drive shaft, and bearing adaptor. The driveline must be capable of rotating at an angle of up to 3° to the bearing mandrel, as well as compensating for the eccentricity caused by the rotation of the rotor in the stator of the PDM. These functions are achieved by means of a flexible mechanical joint housed in the rotor adaptor and in the bearing adaptor. It is common practice in the Oil and Gas drilling industry to use a ball and pocket design, where drive balls are used to transfer torque loads from the PDM to ball pockets in both the rotor adaptor and bearing adaptor housings, thus transferring the torque to the bearing mandrel and drill bit.

The typical ball drive system used in the industry incorporates semi-circular ball pockets located in the rotor adaptor housing and bearing adaptor housing with a geometry that creates a very thin line of contact between drive balls and ball pockets, producing high point loading. Moreover, the point loading is not evenly distributed along the line of contact because of the geometry of the drive ball.

The problem faced with this design is that the contact surface has high point loading along the line of contact that tends to deform and damage the ball pockets and can lead to cracking and, potentially, catastrophic failure.

Therefore, there exists a need for a novel ball drive system that alleviates the shortcomings of the prior art, and more specifically, reduces the point loading of the drive ball on the ball pocket while still maintaining full multidirectional articulation of the drive shaft within the rotor adaptor and bearing adaptor housings.

This background information is provided to reveal information believed by the applicant to be of possible relevance to the present invention. No admission is necessarily intended, nor should be construed, that any of the preceding information constitutes prior art against the present invention.

SUMMARY OF THE INVENTION

An object of the present invention is to provide a ball drive system and a driveline including a rotor adaptor and a bearing adaptor. The rotor adaptor and the bearing adaptor each including a plurality of drive pockets with a flat thrust face. For each of the drive pockets, the system further includes a plurality of flat faced drive balls where the flat face of the flat faced drive balls is matched to the flat thrust face of the drive pockets.

Further embodiments include a removable, hardened thrust ball insert that wears longer and is easily replaced.

In accordance with embodiments of the present invention, there is provided a driveline including a rotor adaptor coupled to an end of a drive shaft and a bearing adaptor coupled to an opposite end of the drive shaft. The rotor adaptor includes a first plurality of drive pockets, each of the first plurality of drive pockets receiving a flat faced drive ball rotatably held between each of the first plurality of drive pockets and the end of the drive shaft. The bearing adaptor includes a second plurality of drive pockets, each of the second plurality of drive pockets receiving a flat faced drive ball rotatably held between each of the second plurality of drive pockets and the opposite end of the drive shaft. Each of the plurality of flat faced drive balls includes a flat surface and each of the first plurality of drive pockets and the second plurality of drive pockets includes a flat thrust face, the flat surface receiving a rotational force from the flat thrust face in response to rotating the rotor adaptor In a further embodiment, the end of the drive shaft or the opposite end of the drive shaft comprises a removable thrust ball end.

In a further embodiment, a plane of the flat thrust face is perpendicular to a circumferential direction of movement of the rotor adaptor or the bearing adaptor.

In a further embodiment, each of the plurality of flat faced drive balls is oriented so that the flat surface of each of the plurality of flat faced drive balls makes a planar point of contact with one of the flat thrust faces.

In accordance with embodiments of the present invention, there is provided a ball drive system including a plurality of flat faced drive balls and a ball drive pocket housing including a plurality of ball drive pockets distributed around an inner circumference of the housing. Each of the plurality of drive pockets formed to rotatably receive a flat faced drive ball. Each of the plurality of flat faced drive balls includes a flat surface and each of the plurality of drive pockets includes a flat thrust face, the flat surface receiving a rotational force from the flat thrust face in response to a rotational movement of the drive pocket housing.

In further embodiments, each of the plurality of flat faced drive balls is oriented so that the flat surface of each of the plurality of flat faced drive balls makes a planar point of contact with one of the flat thrust faces.

Embodiments have been described above in conjunction with aspects of the present invention upon which they can be implemented. Those skilled in the art will appreciate that embodiments may be implemented in conjunction with the aspect with which they are described but may also be implemented with other embodiments of that aspect. When embodiments are mutually exclusive, or are otherwise incompatible with each other, it will be apparent to those skilled in the art. Some embodiments may be described in relation to one aspect, but may also be applicable to other aspects, as will be apparent to those of skill in the art.

BRIEF DESCRIPTION OF THE FIGURES

FIGS. 8A-8C illustrates a removable thrust ball end, according to an embodiment.

It will be noted that throughout the appended drawings, like features are identified by like reference numerals.

DETAILED DESCRIPTION OF THE INVENTION

Embodiments of the invention will now be described with reference to specific examples. It will be understood that the following examples are intended to describe embodiments of the invention and are not intended to limit the invention in any way. Unless defined otherwise, all technical and scientific terms used herein have the same meaning as commonly understood by one of ordinary skill in the art to which this invention belongs.

Embodiments of the present invention provide a ball drive system and a driveline including a rotor adaptor housing and a bearing adaptor housing. The rotor adaptor and the bearing adaptor each include a plurality of drive pockets with a flat thrust face. For each of the drive pockets, the system further includes a plurality of flat faced drive balls where the flat face of the flat faced drive balls is matched to the flat thrust face of the drive pockets. A plurality of flat faced drive balls is employed, with the exact number being determined by the size requirements and particular applications of the driveline. The flat faced drive balls may also be of various diameters to suit particular applications.

Further embodiments include a removable, hardened thrust ball insert that wears longer and is easily replaced. The thrust ball is inserted into the rotor adaptor housing and the bearing adaptor housing with the flat faced drive balls rotatably held between the thrust ball and its associated housing.

Embodiments reduce the point loading of the flat faced drive ball on the drive pocket thrust face while still maintaining full multidirectional articulation of the drive shaft within the rotor adaptor housing and the bearing adaptor housing. The flexible drive connection functions in a similar manner to a constant velocity joint (CV joint) and avoids geometric locking and reduces vibrations.

Figure 1:
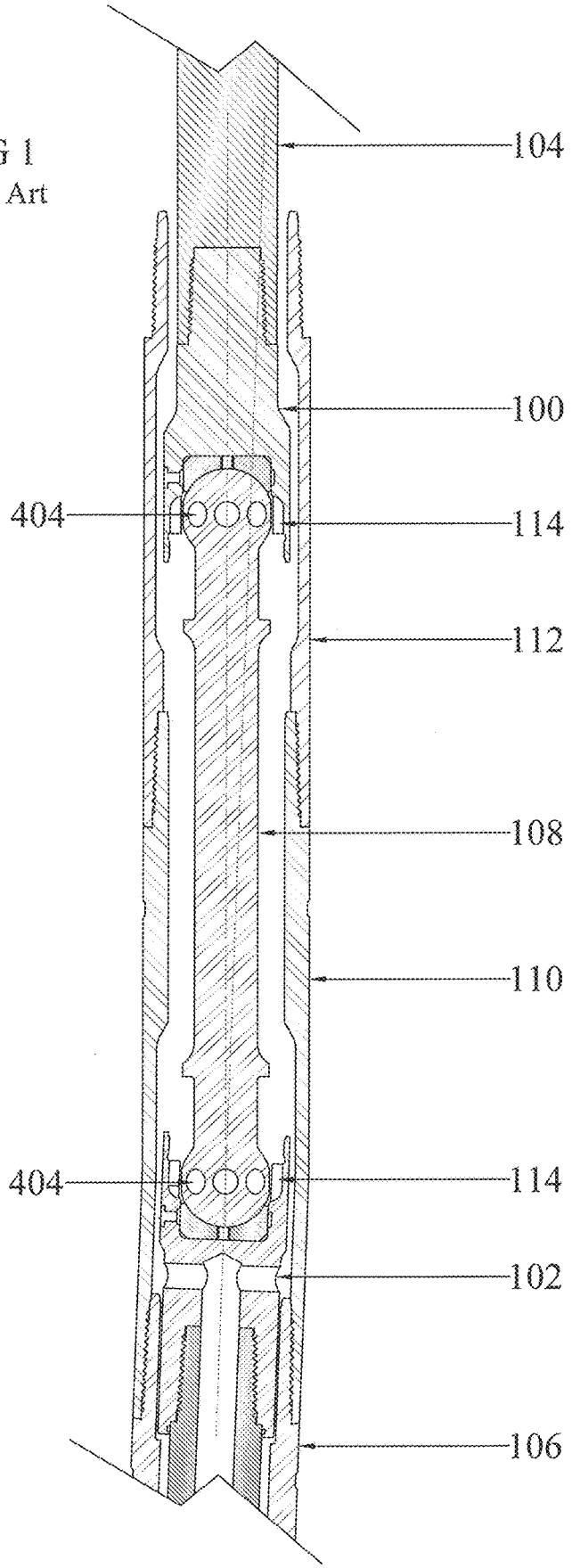
FIG 1 Prior Art
FIG. 1 illustrates a prior art ball drive system that may be used to transfer the torque from a rotor of a motor to a drill bit via a driveline and bearing pack.

FIG. 1 illustrates a ball drive system that may be used to transfer the torque from a rotor of a motor, such as a hydraulic positive displacement motor (PDM) 104, to a drill bit via a driveline and bearing pack. A driveline consists of an outer housing 110, a rotor adaptor 100, drive balls 302, a drive shaft 108, and a bearing adaptor 102. The driveline is encased by an outer housing 112, covering the rotor adaptor 100 and an upper portion of the drive shaft 108, an outer housing 110, covering a lower portion of the drive shaft 108, and the bearing adaptor housing 102. The rotor adaptor housing 100 connects the PDM rotor 104 to the drive shaft 108 and incorporates ball pockets 114 that transfer the torque from the rotor 104 to the drive balls 302 which in turn drive the drive shaft 108. The motor 104 may be replaced with any other source of rotational torque.

The drive shaft 108 incorporates an integral spherical geometry at each end of the shaft, which act as thrust balls 702 that transmit the inherent axial loads exerted on the rotor and bearing adaptors by the power section. The bearing adaptor housing 102 connects the drive shaft 108 to the bearing mandrel 106 and incorporates the ball pockets 114 that transfer the torque from the drive shaft 108 to the drive balls 302 which then drive the bearing housing adaptor 102 and, in turn, the bearing mandrel 106. The ball pockets of the bearing housing adaptor 102 may have the same geometry as those employed in the rotor adaptor housing 100.

In embodiments, the driveline may be capable of rotating at an angle of up to 3° to the bearing mandrel 106, as well as compensating for the eccentricity caused by the rotation of the rotor 104 in a stator of the PDM. The combination of the rotor adaptor housing 100 and flat faced drive balls 303 and of the bearing adaptor housing 102 and flat faced drive balls 303, may both provide flexible mechanical joints. Components of the driveline, such as rotor adaptor housing 100 or the bearing adaptor 102, may be manufactured from alloy steels that can either be gas nitrided or carburized to further increase yield strength and surface hardness in areas such as on the ball pocket thrust face. In another embodiment, the incorporation of a polycrystalline diamond wear pad into the drive pocket thrust face 204 further increases the surface hardness and significantly reduces friction.

Figure 2:
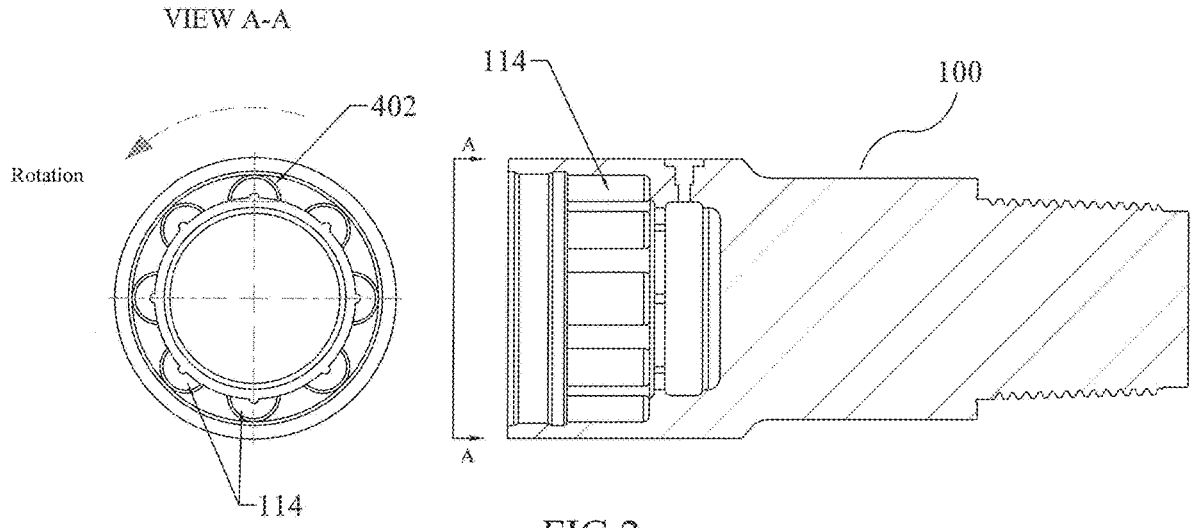
FIG 2 Prior Art
FIG. 2 illustrates a cross section and detail view of a prior art rotor adaptor housing.
Figure 3:
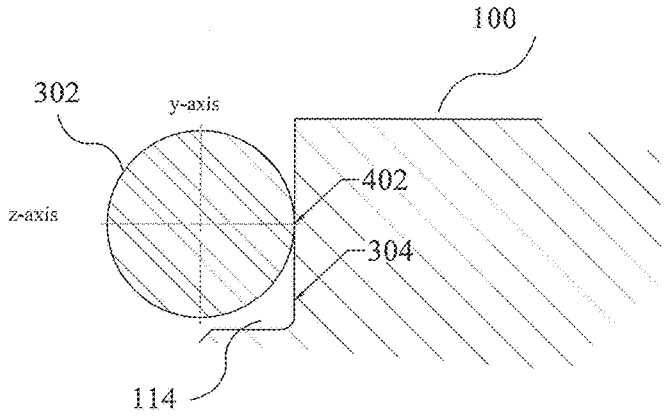
FIG 3 Prior Art
FIG. 3 illustrates a drive ball interfacing to a prior art ball pocket.

FIG. 2 illustrates a cross section and detail view of a prior art rotor adaptor housing 100. The bearing adaptor housing 102 has a similar cross section in the area of the ball pockets 114. FIG. 3 illustrates a drive ball 302 interfacing to a ball pocket 114. Drive ball 302 and ball pocket 114 implement what is known as a ball and pocket design or a ball drive system. The open face of rotor adaptor housing 100, view A-A shows a plurality of ball pockets 114 that each accept a drive ball 302. Ball pockets 114 are distributed around the circumference of the rotor adaptor housing 100. When rotor adaptor housing 100 is rotated, the thrust face 304 of each ball pocket applies a force tangential to the circumference of the rotor adaptor housing 114 to their corresponding drive ball 302 at the point of contact 402. The drive balls 302, are spherical or generally spherical and facilitate omni-directional functionality and transmit the torque loads from the power section of the PDM into the vertical face (point of contact 402) of the ball pockets 114 in both the rotor adaptor housing 100 and the bearing adaptor housing 102, thus transferring the torque to the bearing mandrel 106 and drill bit (not shown).

Figure 4A:
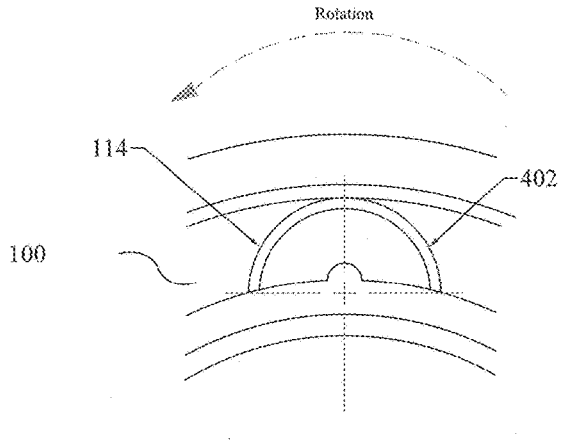
FIG 4A Prior Art
FIGS. 4A-4D illustrate the forces that a prior art ball pocket makes on a drive ball.
Figure 4B:
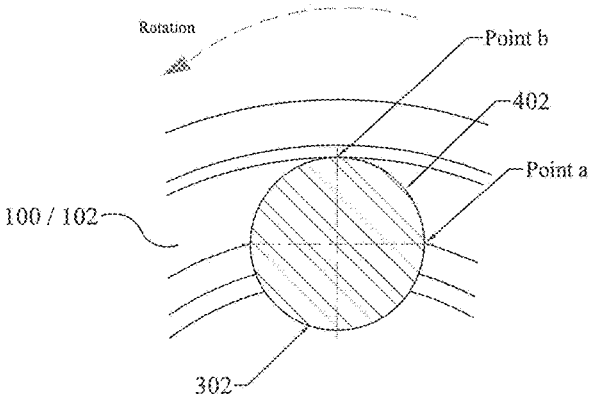
FIG 4B Prior Art
Figure 4C:
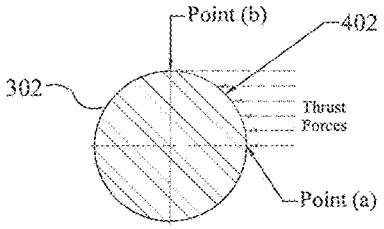
FIG 4C Prior Art
Figure 4D:
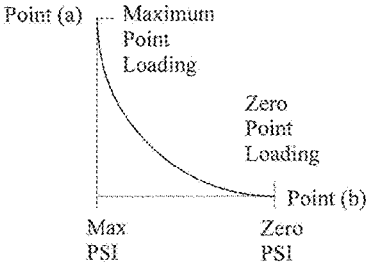
FIG 4D Prior Art

As illustrated in FIG. 4A to FIG. 4D, the ball drive system incorporates ball pockets 114 located in the rotor adaptor housing 100 and in the bearing adaptor housing 102. As seen in FIG. 4A, the inner profile of the ball pocket face 402 is fashioned to closely match the shape of the drive ball 302 and only makes contact along the Z-axis (see FIG. 3) of the drive ball 302. FIG. 4B illustrates a drive ball 302 in place within a ball pocket 114. The interface between the point of contact 402 of the drive ball 302 and the thrust face 304 of the ball pocket 114 produced a loading area over which the rotational force is distributed. FIG. 4C illustrates how thrust forces from the ball pocket 114 make contact with drive ball 302. FIG. 4D illustrates how the thrust forces are unevenly distributed, concentrating the forces towards Point (a) and further increasing the point loading. Conversely, embodiments of the invention distribute the thrust forces over a large area of the flat faced drive ball 303 as shown in FIG.

6 and evenly distribute the thrust forces at the point of contact between the drive pocket 214 and the flat faced drive ball 303.

Figure 5A:
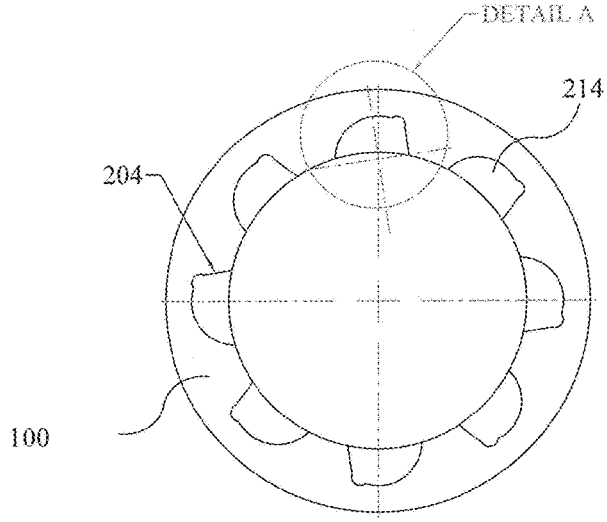
FIGS. 5A and 5B illustrate a drive pocket of a rotor adaptor housing or a bearing adaptor, according to an embodiment.
Figure 5B:
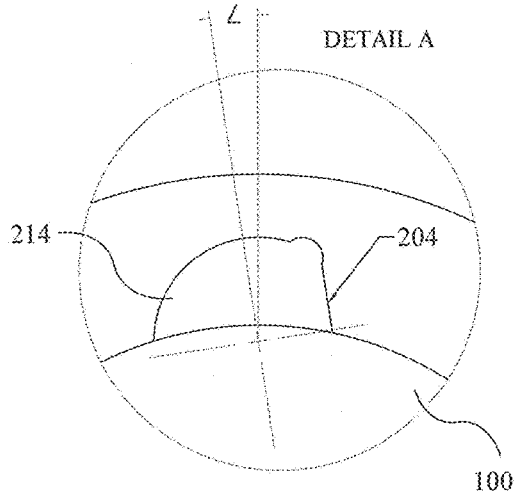
Figure 6:
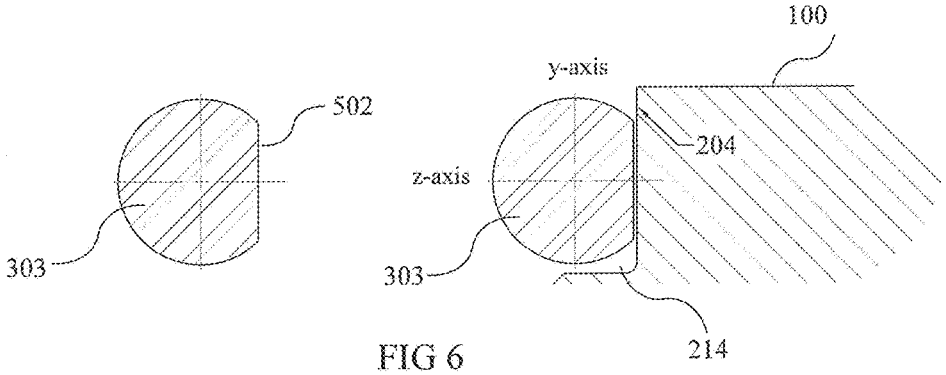
FIG. 6 illustrates a flat faced drive ball with a flat surface, in accordance with an embodiment.

FIG. 5A illustrates a drive pocket 214 of a rotor adaptor housing 100 or a bearing adaptor 102, according to an embodiment. FIG. 5B provides a close-up detail view of drive pocket 214, similar to view A-A of FIG. 2. Drive pocket 214 is formed with a flat thrust face 204 on the side of the drive pocket that includes the point of contact with the flat faced drive ball 303. As illustrated in FIG. 6, flat faced drive balls 303 are spheres with a truncated section that creates a flat surface 502 on one side that has been precision ground to a specific dimension corresponding to the thrust face 204 of the drive pocket 214. The flat surface 502 of the flat faced drive ball 303 provides a substantially sized contact area to receive the force exerted by the thrust face 204 and reduces the loading on the thrust face 204. The reduction in loading helps to reduce the chance of damage or deformation of the drive pocket 214 when in use and effectively increases the service life of the rotor adaptor housing 100 and the bearing adaptor housing 102. This in turn substantially mitigates the risk of a catastrophic failure downhole which would require a trip out of hole to replace the drilling motor.

Figure 7:
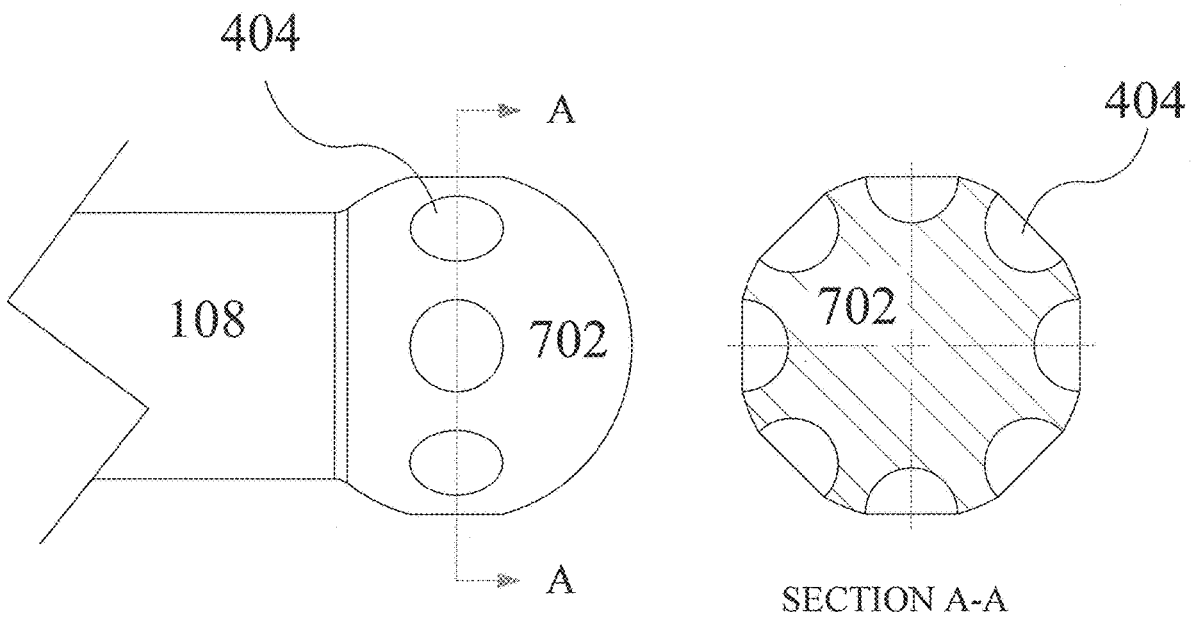
FIG. 7 illustrates a thrust ball, for use with an embodiment.

FIG. 7 illustrates a thrust ball 702, for use with an embodiment. The drive shaft 108 design may incorporate an integral spherical geometry at each end of the shaft, which act as thrust balls 702 that transmit or receive the inherent axial loads exerted on the rotor 100 and bearing 102 adaptors. As illustrated in FIG. 1, drive shaft 108 includes a thrust ball 702 at either end to transfer the rotational motion of the PDM rotor 104 to the drive shaft 108, and the rotational motion of drive shaft 108 to the bearing mandrel 106. A plurality of flat faced drive balls (not shown) would be arranged around the outside circumference of the thrust balls 702 and are located in semi spherical cavities 404. Thrust balls 702 experience large forces and wear over time.

In accordance with an embodiment, FIG. 8 illustrates a removable thrust ball end 802 that may be manufactured from hardened alloy steel. Thrust ball ends, or inserts 802, may be fixed to the thrust ball 702 ends and be used as the solid, machined profile of the drive shaft 108. The use of an insert 802 resists wear and may considerably extend the service life of the drive shaft 108. In another embodiment, the removeable thrust ball insert 802 or the solid thrust ball end 702 incorporates a plurality of polycrystalline diamond wear pad inserts 804 fixed into the spherical surface FIG. 8-C.

Other than in the energy exploration and production industry, embodiments may be used in a multitude of applications that require a drive shaft such as mining, marine, earth moving, general industry, heavy industry, etc.

Although the present invention has been described with reference to specific features and embodiments thereof, it is evident that various modifications and combinations can be made thereto without departing from the invention. The specification and drawings are, accordingly, to be regarded simply as an illustration of the invention as defined by the appended claims, and are contemplated to cover any and all modifications, variations, combinations, or equivalents that fall within the scope of the present invention.

I claim:

1. A driveline comprising:

a rotor adaptor coupled to an end of a drive shaft;

a bearing adaptor coupled to an opposite end of the drive shaft;

the rotor adaptor including a first plurality of drive pockets, each of the first plurality of drive pockets receiving a flat faced drive ball rotatably held between each of the first plurality of drive pockets and the end of the drive shaft; and the bearing adaptor including a second plurality of drive pockets, each of the second plurality of drive pockets receiving a flat faced drive ball rotatably held between each of the second plurality of drive pockets and the opposite end of the drive shaft;

wherein each of the plurality of flat faced drive balls is a sphere with a truncated section that creates a flat surface and each of the first plurality of drive pockets and the second plurality of drive pockets includes a flat thrust face, the flat surface receiving a rotational force from the flat thrust face in response to rotating the rotor adaptor.

2. The driveline of claim 1 wherein the end of the drive shaft or the opposite end of the drive shaft comprises a removable thrust ball end.

3. The driveline of claim 1 wherein a plane of the flat thrust face is perpendicular to a circumferential direction of movement of the rotor adaptor or the bearing adaptor.

4. The driveline of claim 3 wherein each of the plurality of flat faced drive balls is oriented so that the flat surface of each of the plurality of flat faced drive balls makes a planar point of contact with one of the flat thrust faces.

5. The driveline of claim 1 wherein a plane of the flat thrust face is at an obtuse angle to a circumferential direction of movement of the rotor adaptor or the bearing adaptor.

6. A ball drive system comprising:

a plurality of flat faced drive balls, each said flat faced drive ball being a sphere with a truncated section that creates a flat surface; and a drive pocket housing including a plurality of drive pockets distributed around an inner circumference of the housing, each of the plurality of drive pockets formed to rotatably receive a flat faced drive ball;

wherein each of the plurality of flat faced drive balls includes a flat surface and each of the plurality of drive pockets includes a flat thrust face, the flat surface receiving a rotational force from the flat thrust face in response to a rotational movement of the drive pocket housing.

7. The driveline of claim 6 wherein each of the plurality of flat faced drive balls is oriented so that the flat surface of each of the plurality of flat faced drive balls makes a planar point of contact with one of the flat thrust faces.

* * * * *